US008948433B2

(12) United States Patent
Akino

(10) Patent No.: US 8,948,433 B2
(45) Date of Patent: Feb. 3, 2015

(54) NARROW-ANGLE DIRECTIONAL MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 192 days.

(21) Appl. No.: 13/445,642

(22) Filed: Apr. 12, 2012

(65) Prior Publication Data

US 2012/0263333 A1 Oct. 18, 2012

(30) Foreign Application Priority Data

Apr. 15, 2011 (JP) ..... 2011-91113

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/02*** | (2006.01) |

(52) U.S. Cl.
CPC . *H04R 1/025* (2013.01); *H04R 9/08* (2013.01)
USPC ..... 381/356; 381/361; 381/366

(58) Field of Classification Search
CPC ..... H04R 1/08; H04R 1/083; H04R 1/406; H04R 1/04; H04R 1/38; H04R 19/04; H04R 1/342; H04R 9/08; H04R 1/345; G10D 1/085; H04M 1/03; G11B 5/00; G11B 2005/002
USPC ..... 381/356, 361, 366
See application file for complete search history.

(56) References Cited

U.S. PATENT DOCUMENTS

| | | | | |
|---|---|---|---|---|
| 3,324,254 | A * | 6/1967 | Shaw | 381/363 |
| 7,558,397 | B2 * | 7/2009 | Akino | 381/369 |
| 7,575,095 | B2 * | 8/2009 | An et al. | 181/199 |
| 7,623,671 | B2 * | 11/2009 | Akino | 381/356 |
| 7,801,321 | B2 * | 9/2010 | Akino | 381/355 |

(Continued)

FOREIGN PATENT DOCUMENTS

| | | |
|---|---|---|
| JP | 2008-103982 A | 5/2008 |
| JP | 2008-103984 A | 5/2008 |

(Continued)

OTHER PUBLICATIONS

Japan Patent Office, "Office Action for JP 2011-091113," Jul. 10, 2014.

*Primary Examiner* — Matthew Eason
*Assistant Examiner* — Sean H Nguyen
(74) *Attorney, Agent, or Firm* — Manabu Kanesaka

(57) ABSTRACT

Provided is a narrow-angle directional microphone in which a microphone unit is attached to an acoustic tube, the acoustic tube is accommodated a microphone case and which prevents the rattling of components provided in the microphone case and has high mechanical strength. A narrow-angle directional microphone 1 includes a microphone unit 2, an acoustic tube 3 that has an opening formed in a circumferential wall along an axis direction and a rear end to which the microphone unit is connected, a cylindrical microphone case 4 that accommodates the acoustic tube, and fixing means 3*a*, 4*a*, 10, and 20*a* that fix the acoustic tube in the microphone case, with stress being applied to the acoustic tube in the microphone case in the axis direction from the leading end side of the acoustic tube using the rear end of the acoustic tube as a fulcrum.

6 Claims, 6 Drawing Sheets

(56) References Cited

U.S. PATENT DOCUMENTS

| | | | | |
|---|---|---|---|---|
| 2010/0239113 | A1* | 9/2010 | Browne | 381/361 |
| 2011/0013800 | A1* | 1/2011 | Akino | 381/361 |

FOREIGN PATENT DOCUMENTS

| | | | | |
|---|---|---|---|---|
| JP | 2010-245994 | | 10/2010 | |
| JP | 2010245994 | * | 10/2010 | H04R 1/34 |

* cited by examiner

NARROW-ANGLE DIRECTIONAL MICROPHONE

BACKGROUND OF THE INVENTION

1. Field of the Invention

The present invention relates to a narrow-angle directional microphone in which a microphone unit is attached to an acoustic tube, and more particularly, to a narrow-angle directional microphone that prevents the rattling of components provided in a microphone case and has high mechanical strength.

2. Description of the Related Art

A narrow-angle directional microphone has been known which uses an elongated acoustic tube. In the narrow-angle directional microphone, a microphone unit is attached to the inner circumferential surface of one end of the acoustic tube, detects a sound wave input through an opening which is provided at the leading end, which is the other end of the acoustic tube, and converts the sound wave into an audio signal.

In an example of the narrow-angle directional microphone using the acoustic tube according to the related art, as illustrated in FIG. 6, an acoustic tube 50, which is a metal tube, is used, openings 51 having, for example, a slit shape are provided in the circumferential wall of the acoustic tube 50 along the central axis direction, and an acoustic resistor (not illustrated) made of, for example, a synthetic resin thin film or non-woven fabric is attached to the circumferential wall of the acoustic tube 50 to cover the openings 51.

In the narrow-angle directional microphone having the above-mentioned structure, among the sound waves transmitted from an opening 53 provided at the leading end of the acoustic tube 50, a sound wave which turns around in the circumferential direction interferes with a sound wave which is transmitted from the openings 51 provided in the circumferential wall of the acoustic tube 50 through the acoustic resistor. In this way, narrow-angle directionality is achieved.

Japanese Patent Application Laid-Open (JP-A) No. 2010-245994 discloses the above-mentioned narrow-angle directional microphone using the elongated acoustic tube.

In order to obtain narrow-angle directionality capable of detecting a low-frequency sound wave with the acoustic tube 50, it is necessary to increase the length of the axis of the acoustic tube 50.

Since the narrow-angle directional microphone is generally used outdoors, it needs to have high mechanical strength. Therefore, as disclosed in JP-A No. 2010-245994, the acoustic tube 50 is accommodated in a microphone case (not illustrated), which is a cylindrical housing, and is then used.

However, the acoustic tube 50 comes into substantially close contact with the microphone case. However, when the acoustic tube 50 is long, a small deviation occurs between the microphone case and the acoustic tube 50 in the axis direction or the diametric direction while the narrow-angle directional microphone is held and used. As a result, components (for example, an acoustic tube, a microphone unit, and a connector) provided in the case rattle.

In addition, abnormal noise generated due to the rattling of the components provided in the case is detected by the microphone unit.

SUMMARY OF THE INVENTION

The invention has been made in view of the above-mentioned problems and an object of the invention is to provide a narrow-angle directional microphone in which a microphone unit is attached to an acoustic tube and the acoustic tube is accommodated in a microphone case and which prevents the rattling of components provided in the microphone case and has high mechanical strength.

In order to solve the above problems, according to an aspect of the invention, a narrow-angle directional microphone includes: a microphone unit; an acoustic tube that has an opening formed in a circumferential wall along an axis direction and a rear end to which the microphone unit is connected; a cylindrical microphone case that accommodates the acoustic tube; and a fixing means that fixes the acoustic tube in the microphone case, with stress being applied to the acoustic tube in the microphone case in the axis direction from a leading end side of the acoustic tube using the rear end of the acoustic tube as a fulcrum.

The fixing means may include a first screw portion that is formed on an inner circumferential surface of the leading end of the microphone case; an annular screw including a second screw portion which is formed on an outer circumferential surface and is engaged with the first screw portion, and a locking means that can lock the rear end of the acoustic tube in the axis direction in the microphone case. When the acoustic tube is accommodated in the microphone case and the second screw portion of the annular screw is engaged with the first screw portion which is formed on the inner circumferential surface of the leading end of the microphone case, the rear end of the acoustic tube may be locked to the locking means and serve as a fulcrum, and the acoustic tube may be fixed in the microphone case while being pressed in the axis direction by the annular screw from the leading end side.

The acoustic tube and the microphone unit connected to the rear end of the acoustic tube may be accommodated in the microphone case. Screw holes may be formed in the side surfaces of the microphone unit and the microphone case in a diametric direction, and a screw may be inserted into the screw holes to fix the microphone unit to the microphone case.

According to this structure, a pressing force is applied to the acoustic tube accommodated in the microphone case in the axis direction from the leading end side, using the rear end of the acoustic tube as a fulcrum. In this state, the acoustic tube can be fixed in the microphone case.

In this way, it is possible to prevent the rattling of the acoustic tube, which is a component provided in the microphone case, and thus obtain a narrow-angle directional microphone with high mechanical strength.

Alternatively, the fixing means may include a third screw portion that is formed on the inner circumferential surface of the leading end of the acoustic tube, a leading end cover that is formed such that a lower surface of a circumferential portion can be locked to the leading end of the microphone case in the axis direction and includes a fourth screw portion which is formed on an outer circumferential surface and is engaged with the third screw portion, and a rear-end-side fixing means that can fix the rear end of the acoustic tube to the microphone case in the microphone case. The fourth screw portion of the leading end cover may be engaged with the third screw portion which is formed on the inner circumferential surface of the leading end of the acoustic tube, with the acoustic tube accommodated in the microphone case and the rear end of the acoustic tube fixed by the rear-end-side fixing means. The lower surface of the circumferential portion of the leading end cover may be locked to the leading end of the microphone case in the axis direction. When the leading end cover is rotated in the circumferential direction, the rear end of the acoustic tube may serve as a fulcrum and the acoustic tube may be fixed in the microphone case while being pulled in the axis direction from the leading end side.

In this case, screw holes may be provided in the side surfaces of the rear ends of the microphone case and the acoustic tube in the diametric direction, and a screw may be inserted into the screw hole to fix the rear end of the acoustic tube to the microphone case.

According to this structure, a traction force (stress in the extension direction) is applied to the acoustic tube accommodated in the microphone case in the axis direction from the leading end of the acoustic tube, using the rear end of the acoustic tube as a fulcrum. In this state, the acoustic tube can be fixed in the microphone case.

In this way, it is possible to prevent the rattling of the acoustic tube, which is a component provided in the microphone case, and thus obtain a narrow-angle directional microphone with high mechanical strength.

According to the above-mentioned aspect of the invention, it is possible to provide a narrow-angle directional microphone in which a microphone unit is attached to an acoustic tube and the acoustic tube is accommodated in a microphone case and which prevents the rattling of components provided in the microphone case and has high mechanical strength.

DESCRIPTION OF THE PREFERRED EMBODIMENTS

Figure 1:
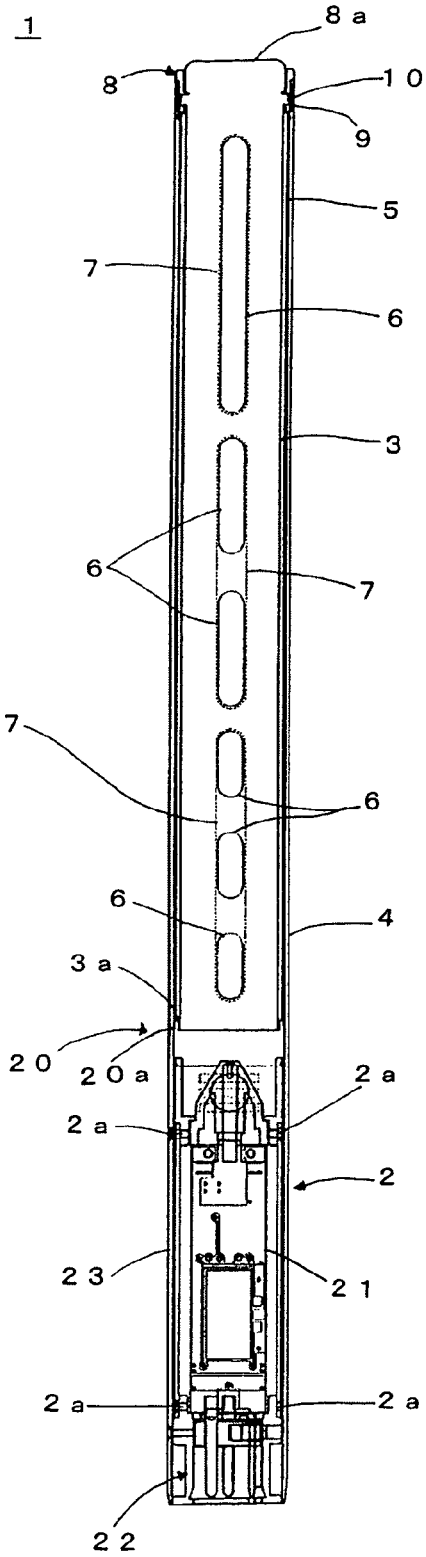
FIG. 1 is a cross-sectional view illustrating the structure of a narrow-angle directional microphone according to a first embodiment of the invention.

Hereinafter, embodiments of the invention will be described with reference to the accompanying drawings. FIG. 1 is a cross-sectional view illustrating a narrow-angle directional microphone according to a first embodiment of the invention.

A narrow-angle directional microphone 1 illustrated in FIG. 1 includes a microphone unit 2, an acoustic tube 3 having a rear end to which the microphone unit 2 is attached, and a microphone case 4 which accommodates the microphone unit 2 and the acoustic tube 3. The entire outer circumferential surface of the acoustic tube 3 is covered with an acoustic resistor 5.

The microphone unit 2 includes an attachment portion 20 which is connected to the rear end (the lower end in FIG. 1) of the acoustic tube 3, an audio signal output circuit board 21, and a connector 22. The audio signal output circuit board 21 is covered with a cylindrical cover 23 which is made of, for example, aluminum.

Figure 2A:
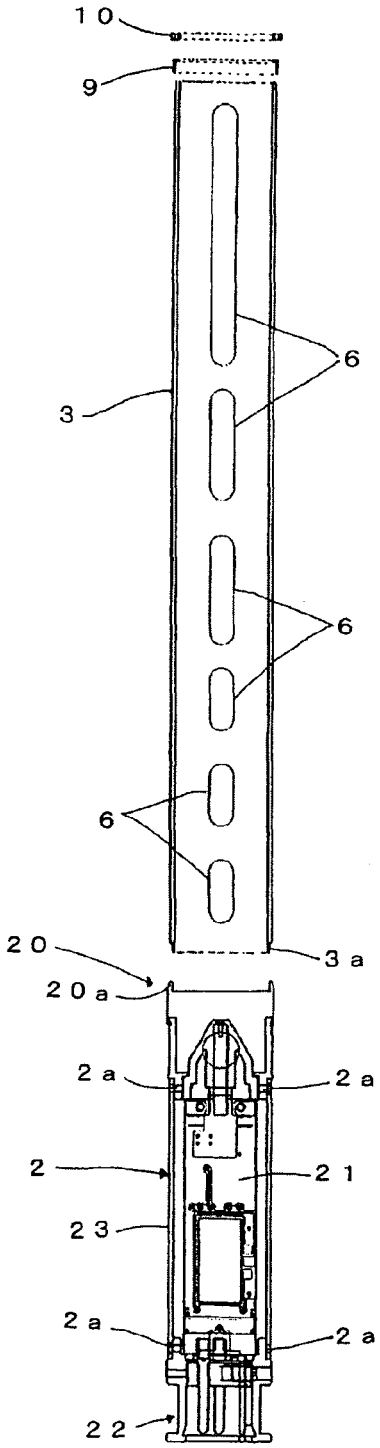
FIGS. 2A and 2B are cross-sectional views illustrating components of the narrow-angle directional microphone illustrated in FIG. 1.

As illustrated in FIG. 2A, an annular locking protrusion 20*a* (a locking means or a fixing means) is formed in the circumference of the attachment portion 20. A step portion 3*a* (a locking means or a fixing means) to which the locking protrusion 20*a* can be locked is formed in the circumference of the rear end of the acoustic tube 3. When the acoustic tube 3 is connected to the microphone unit 2, the locking protrusion 20*a* is locked to the step portion 3*a*, as illustrated in FIG. 1.

The acoustic tube 3 is formed by rolling a rectangular elongated plate made of a metal material, such as aluminum or iron, into an elongated cylinder in the short side direction, as illustrated in FIG. 2A. Both ends of the acoustic tube 3 are opened. As described above, the microphone unit 2 is provided at the rear end (the lower end in FIG. 1) of the acoustic tube 3. As illustrated in FIGS. 1 and 2A, a plurality of slit-shaped openings 6 are formed in a circumferential wall of the acoustic tube 3 along the axis direction.

Figure 2B:
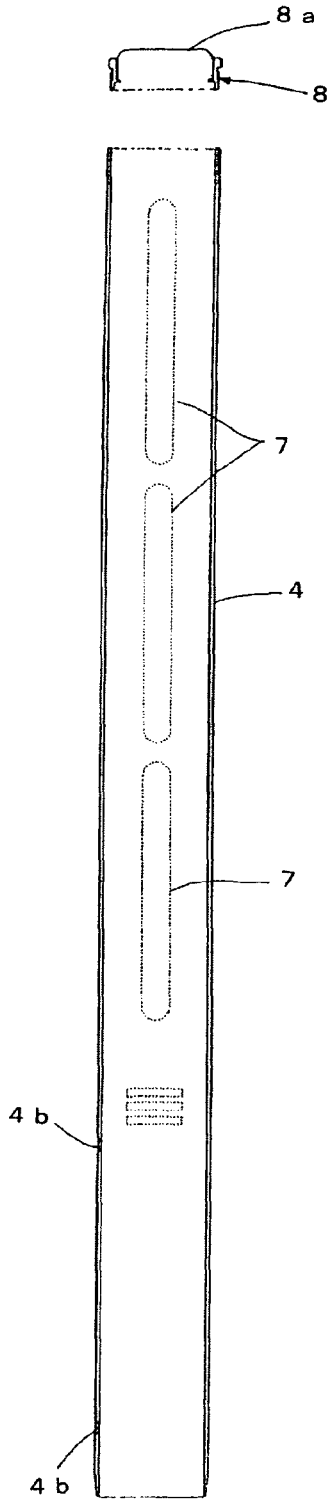

As illustrated in FIG. 2B, a plurality of openings 7 are formed in a circumferential wall of the cylindrical microphone case 4 so as to correspond to the positions of the openings 6 of the acoustic tube 3. Both ends of the microphone case 4 are opened and a leading end cover 8 which includes a mesh cover 8*a* having a plurality of holes formed therein is provided at the leading end (the upper end in FIG. 1) of the microphone case 4.

Figure 3A:
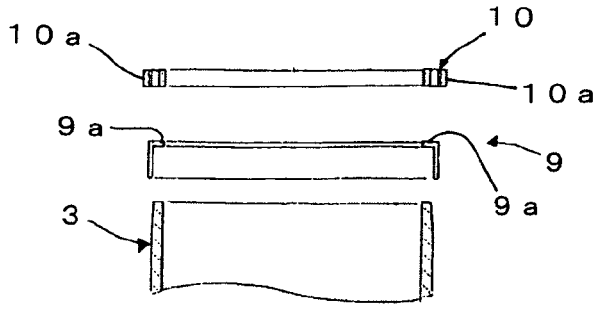
FIGS. 3A to 3C are partial enlarged cross-sectional views illustrating the components of the narrow-angle directional microphone illustrated in FIG. 1.
Figure 3B:
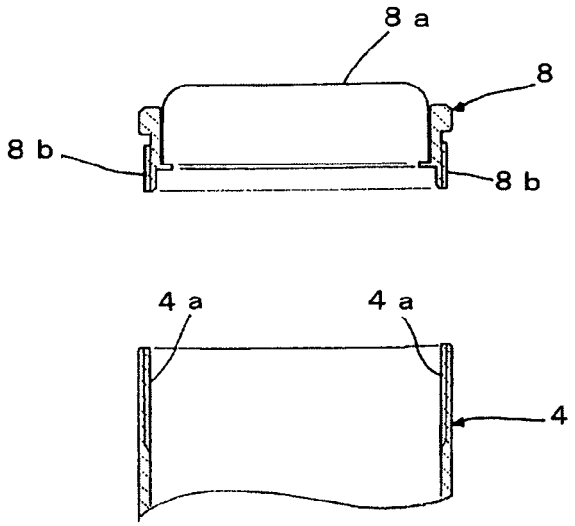

As illustrated in FIG. 3B, a thread groove 4*a* (a first screw portion or a fixing means) is formed on the inner circumferential surface of the leading end of the microphone case 4. A thread ridge 8*b* corresponding to the thread groove 4*a* is formed on the outer circumferential surface of the leading end cover 8. The leading end cover 8 is threadedly attached to the leading end of the microphone case 4.

As illustrated in FIG. 2A, a plurality of screw holes 2*a* are formed in the side surface of the microphone unit 2 along the diametric direction. As illustrated in FIG. 2B, screw holes 4*b* corresponding to the screw holes 2*a* are formed in the side surface of the microphone case 4.

Screws are inserted into the plurality of screw holes 2*a* of the microphone unit 2 accommodated in the microphone case 4 from the outer surface (screw holes 4*b*) of the microphone case 4. In this way, the microphone unit 2 is fixed inside the microphone case 4.

As illustrated in FIG. 3A, the acoustic tube 3 accommodated in the microphone case 4 is fixed inside the microphone case 4 by a flange ring 9 having an annular flange 9*a* provided therein and an annular screw 10 (fixing means) having a thread ridge 10*a* (second screw portion) formed on the outer circumferential surface thereof. The thread ridge 10*a* of the annular screw 10 is formed so as to be engaged with the thread groove 4*a* which is formed on the inner circumferential surface of the leading end of the microphone case 4.

Next, a process of fixing the acoustic tube 3 in the microphone case 4 will be described in detail. First, the microphone unit 2 is accommodated on the rear side of the microphone case 4 and screws are inserted into the plurality of screw holes 2*a* to fix the microphone unit 2.

Then, the acoustic tube 3 is inserted into the microphone case 4 from the leading end side and the step portion 3*a* provided at the rear end of the acoustic tube 3 is locked to the locking protrusion 20*a* of the microphone unit 2.

The flange ring 9 is put on the rear end of the acoustic tube 3 and the annular flange 9*a* is locked to the leading end of the acoustic tube 3.

Figure 3C:
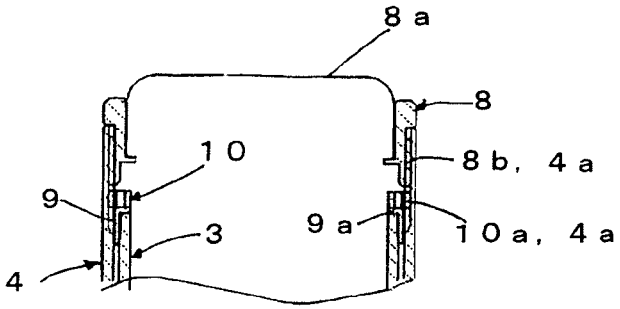

Then, as illustrated in FIG. 3C, the annular screw 10 is engaged with the thread groove 4*a*.

Since the rear end of the acoustic tube 3 is locked to the microphone unit 2, it serves as a fulcrum and the acoustic tube 3 is pressed by the annular screw 10 through the flange ring 9 from the leading end thereof. That is, when the annular screw 10 is tightened, the acoustic tube 3 is gradually compressed in the axis direction and is then fixed in the microphone case 4.

When the acoustic tube 3 is fixed in this way, the leading end cover 8 is threadedly attached and fixed to the leading end of the microphone case 4, as illustrated in FIG. 3C.

As described above, according to the first embodiment of the invention, a pressing force is applied to the acoustic tube 3 which is accommodated in the microphone case 4 from the leading end side using the rear end of the acoustic tube 3 as a fulcrum. In this state, the acoustic tube 3 is fixed in the microphone case 4.

The microphone unit 2 accommodated in the microphone case 4 is screwed from the outer surface of the microphone case 4 and is fixed in the microphone case 4.

In this way, it is possible to prevent the rattling of the acoustic tube 3 and the microphone unit 2 which are provided in the microphone case 4 and thus obtain a narrow-angle directional microphone with high mechanical strength.

In the embodiment, the acoustic tube 3 is locked to the microphone unit 2 fixed in the microphone case 4 from the rear end side and a fulcrum is formed on the rear end side. However, a means for forming the fulcrum is not limited to the above-mentioned structure.

For example, the rear end of the acoustic tube 3 accommodated in the microphone case 4 may be fixed to the microphone case 4 by screws to form the fulcrum on the rear end side of the acoustic tube 3.

Next, a second embodiment of the invention will be described with reference to FIGS. 4 and 5.

In the second embodiment, components having substantially the same functions as those in the first embodiment described with reference to FIGS. 1 to 3C are denoted by the same reference numerals and the detailed description thereof will not be repeated.

Figure 4:
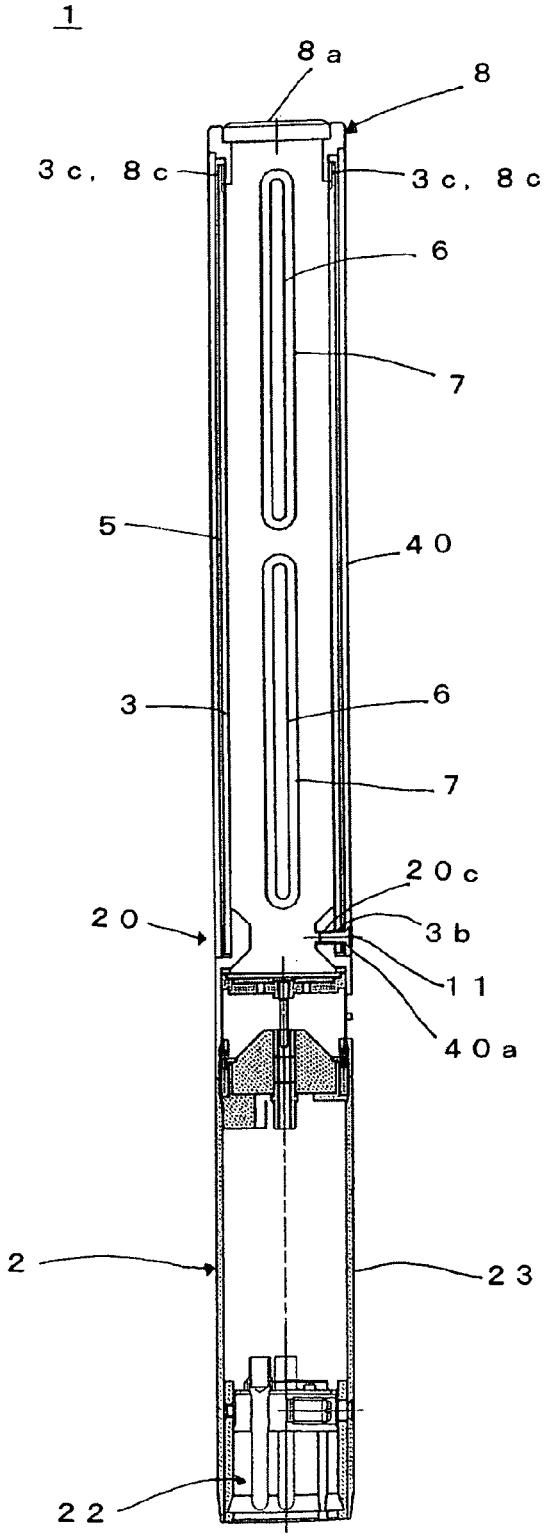
FIG. 4 is a cross-sectional view illustrating the structure of a narrow-angle directional microphone according to a second embodiment of the invention.

A narrow-angle directional microphone 1 illustrated in FIG. 4 includes a microphone unit 2, an acoustic tube 3 having a rear end to which the microphone unit 2 is attached, and a microphone case 40 which accommodates the acoustic tube 3. The entire outer circumferential surface of the acoustic tube 3 is covered with an acoustic resistor 5.

Figure 5A:
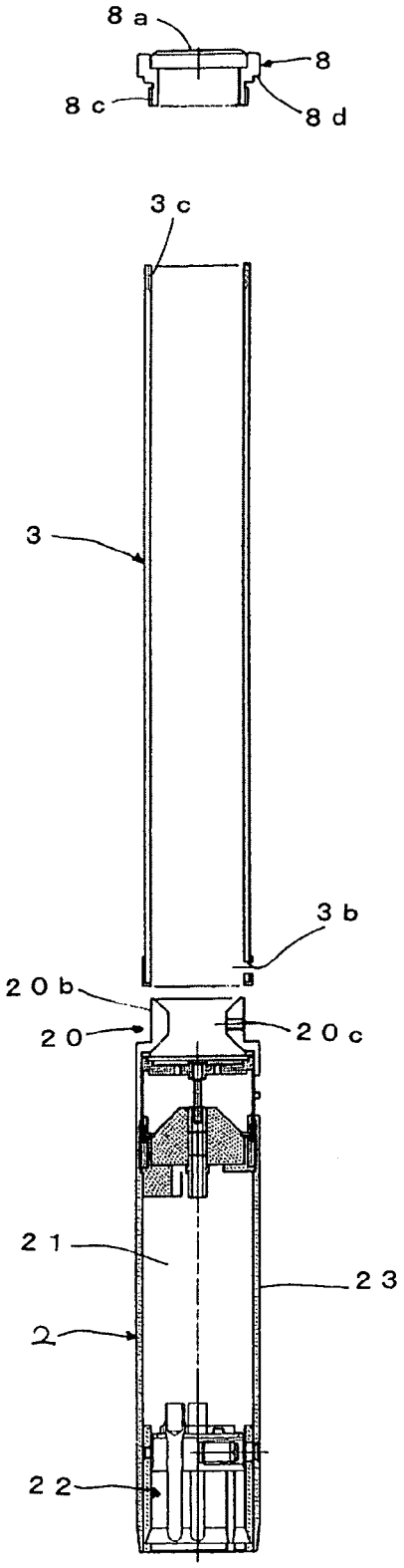
FIGS. 5A and 5B are cross-sectional views illustrating components of the narrow-angle directional microphone illustrated in FIG. 4.
Figure 5B:
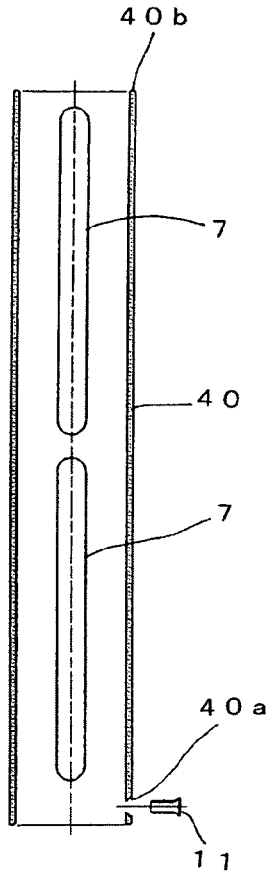
Figure 6:
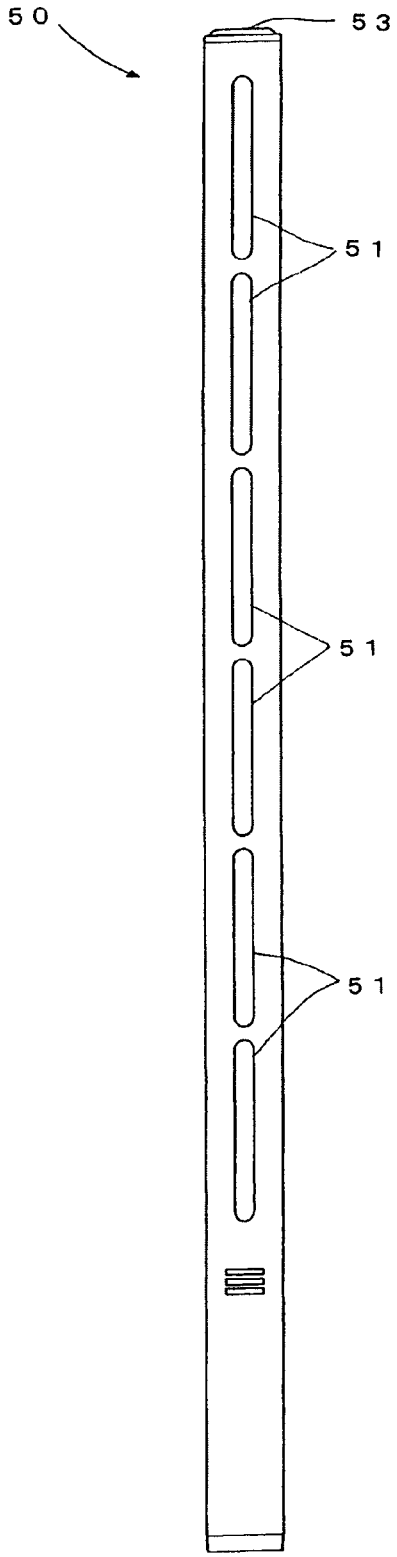
FIG. 6 is a front view illustrating the outward appearance of a narrow-angle directional microphone.

In the microphone unit 2, unlike the first embodiment, an attachment portion 20 connected to the acoustic tube 3 includes a cylindrical insertion portion 20*b* which can be inserted into the rear end (the lower end in FIG. 4) of the acoustic tube 3 and a screw hole 20*c* which is provided in the side surface of the insertion portion 20*b*, as illustrated in FIG. 5A. In addition, as illustrated in FIG. 5A, a screw hole 3*b* (a rear-end-side fixing means or a fixing means) is provided in the side surface of the rear end (the side surface of the lower end in FIG. 5A) of the acoustic tube 3 so as to correspond to the screw hole 20*c* of the microphone unit 2. As illustrated in FIG. 5B, a screw hole 40*a* (a rear-end-side fixing means or a fixing means) is formed in the side surface of the rear end (the side surface of the lower end in FIG. 5B) of the microphone case 40.

Therefore, as illustrated in FIG. 4, when the attachment portion 20 (insertion portion 20*a*) of the microphone unit 2 is inserted into the rear end of the acoustic tube 3 and the acoustic tube 3 is accommodated in the microphone case 40, the screw holes 20*c*, 3*b*, and 40*a* are aligned with each other and a screw 11 (a rear-end-side fixing means or a fixing means) is inserted into the screw holes 20*c*, 3*b*, and 40*a* to connect and fix the acoustic tube 3, the rear end of the microphone case 4, and the leading end of the microphone unit 2.

As illustrated in FIG. 5A, a thread groove 3*c* (third screw portion, fixing means) is formed on the inner circumferential surface of the leading end of the acoustic tube 3.

A thread ridge 8*c* (fourth screw portion) is formed on the outer circumferential surface of the leading end cover 8 (fixing means) so as to correspond to the thread groove 3*c* and the leading end cover 8 is threadedly attached to the leading end of the acoustic tube 3.

As described above, the leading end cover 8 is attached to the acoustic tube 3 having the rear end fixed to the microphone case 40 by the screw 11. In this way, the acoustic tube 3 is fixed to the microphone case 40.

A process of fixing the acoustic tube 3 in the microphone case 40 will be described in detail below. First, the attachment portion 20 (insertion portion 20*b*) of the microphone unit 2 is inserted into the rear end of the acoustic tube 3 and the acoustic tube 3 is covered with the microphone case 40.

Then, the screw 11 is inserted into the screw holes 20*c*, 3*b*, and 40*a* to connect and fix the acoustic tube 3, the rear end of the microphone case 4, and the leading end of the microphone unit 2 (the rear end of the acoustic tube 3 is fixed).

Then, the leading end cover 8 is threadedly connected to the leading end of the acoustic tube 3 which is accommodated in the microphone case 40.

During the threaded connection, the leading end cover 8 is rotated in the screwing direction (circumferential direction), with a lower surface 8*d* of the circumference of the leading end cover 8 being locked to the leading end surface 40*b* of the microphone case 40 in the axis direction.

In this way, the rear end of the acoustic tube 3 serves as a fulcrum and the acoustic tube 3 is pulled from the leading end side in the axis direction (the upper side in FIG. 4). That is, when the leading end cover 8 is rotated in the screwing direction, the acoustic tube 3 is gradually pulled in the axis direction in the microphone case 4 and is then fixed.

As such, according to the second embodiment, a traction force (stress in the extension direction) is applied to the acoustic tube 3 accommodated in the microphone case 4 in the axis direction from the leading end of the acoustic tube 3, using the rear end of the acoustic tube 3 as a fulcrum. In this state, the acoustic tube 3 is fixed in the microphone case 4.

In this way, it is possible to prevent the rattling of the acoustic tube 3 provided in the microphone case 4 and thus obtain a narrow-angle directional microphone with high mechanical strength.

In the first and second embodiments, the first and third screw portions are thread grooves and the second and fourth screw portions are thread ridges. However, the shapes of the screw portions are not limited thereto. For example, the first and third screw portions may be thread ridges and the second and fourth screw portions may be thread grooves. That is, the first (third) screw portion and the second (fourth) screw portion may have shapes which can be engaged with each other.

What is claimed is:

1. A narrow-angle directional microphone comprising:

a microphone unit;

an acoustic tube having an opening formed in a circumferential wall along an axis direction and a rear end connected to the microphone unit;

a cylindrical microphone case accommodating the acoustic tube; and a fixing device fixing the acoustic tube in the microphone case, with stress being applied to the acoustic tube in the microphone case in the axis direction from a leading end side of the acoustic tube toward the rear end of the acoustic tube as a fulcrum, wherein the fixing device includes:

a first screw portion formed on an inner circumferential surface of a leading end of the microphone case;

an annular screw including a second screw portion formed on an outer circumferential surface and engaged with the first screw portion; and a locking device locking the rear end of the acoustic tube in the axis direction to the microphone case, the locking device includes an annular locking protrusion formed at a front end of the microphone unit, and a step portion formed at the rear end of the acoustic tube to engage with the annular locking protrusion, the microphone unit is accommodated in the microphone case and fixed thereto, the acoustic tube is placed on the microphone unit at the rear end, and the fixing device fixes a front end of the acoustic tube inside the microphone case, and when the acoustic tube is accommodated in the microphone case and the second screw portion of the annular screw is engaged to the first screw portion, the rear end of the acoustic tube is locked to the locking device, and the acoustic tube is fixed in the microphone case while being pressed in the axis direction by the annular screw from the leading end side.

2. The narrow-angle directional microphone according to claim 1, wherein the acoustic tube and the microphone unit connected to the rear end of the acoustic tube are accommodated in the microphone case, screw holes are formed in side surfaces of the microphone unit and the microphone case in a diametric direction, and a screw is inserted into the screw holes to fix the microphone unit to the microphone case.

3. A narrow-angle directional microphone, comprising:

a microphone unit including a cylindrical insertion portion;

an acoustic tube having an opening formed in a circumferential wall along an axis direction and a rear end inserted into the cylindrical insertion portion to connect to the microphone unit;

a cylindrical microphone case accommodating the acoustic tube;

screw holes provided in side surfaces of a rear end of the microphone case and the rear end of the acoustic tube in a diametric direction;

a screw inserted into the screw holes to fix the rear end of the acoustic tube to the microphone case; and a fixing device fixing the acoustic tube in the microphone case, with stress being applied to the acoustic tube in the microphone case in the axis direction from a leading end side of the acoustic tube toward the rear end of the acoustic tube as a fulcrum;

wherein the fixing device includes:

a first screw portion formed on an inner circumferential surface of the leading end of the acoustic tube;

a leading end cover including a lower surface of a circumferential portion locking to a leading end of the microphone case in the axis direction, and a second screw portion formed on an outer circumferential surface thereof to engage with the first screw portion; and a rear-end-side fixing device fixing the rear end of the acoustic tube to the microphone case in the microphone case, the rear-end-side fixing device is a screw hole aligned to the screw hole provided in the side surface of the rear end of the microphone case to insert the screw through the rear-end-side fixing device and the screw hole provided in the side surface of the rear end of the microphone case, the second screw portion of the leading end cover is engaged with the first screw portion in a state in which the acoustic tube is accommodated in the microphone case and the rear end of the acoustic tube is fixed by the rear-end-side fixing device, the lower surface of the circumferential portion of the leading end cover is locked to the leading end of the microphone case in the axis direction, and when the leading end cover is rotated in a circumferential direction, the rear end of the acoustic tube serves as a fulcrum and the acoustic tube is fixed in the microphone case while being pulled in the axis direction from a leading end side.

4. The narrow-angle directional microphone according to claim 1, wherein the first screw portion of the microphone case is a thread groove, and the second screw portion is a thread ridge formed on the outer circumferential surface of the annular screw to screw into the first screw portion so that when the annular screw is screwed into the first screw, the acoustic tube is urged to the microphone unit and is fixed to the microphone case.

5. The narrow-angle directional microphone according to claim 4, further comprising:

a leading end cover having a first thread ridge formed on an outer circumferential surface to screw into the first screw portion of the microphone case.

6. The narrow-angle directional microphone according to claim 5, further comprising:

a flange ring having an annular flange disposed at the leading end of the acoustic tube to fix the acoustic tube in the microphone case.

* * * * *